US012781962B2

(12) United States Patent
Mulvany

(10) Patent No.: US 12,781,962 B2
(45) Date of Patent: Nov. 3, 2026

(54) MULTIFUNCTIONAL IGNITION DEVICE

(71) Applicant: Abellio Ltd, Kells (IE)

(72) Inventor: David Mulvany, County Dublin (IE)

(73) Assignee: Abellio Ltd, Kells (IE)

( * ) Notice: Subject to any disclaimer, the term of this patent is extended or adjusted under 35 U.S.C. 154(b) by 362 days.

(21) Appl. No.: 18/381,582

(22) Filed: Oct. 18, 2023

(65) Prior Publication Data

US 2025/0012443 A1 Jan. 9, 2025

(51) Int. Cl.

| | |
|---|---|
| ***F23Q 2/32*** | (2006.01) |
| ***F23Q 1/06*** | (2006.01) |
| ***F23Q 2/02*** | (2006.01) |
| ***F23Q 2/50*** | (2006.01) |

(52) U.S. Cl.

CPC ..... *F23Q 2/32* (2013.01); *F23Q 2/02* (2013.01); *F23Q 2/50* (2013.01)

(58) Field of Classification Search

CPC ..... F23Q 1/06; F23Q 2/02; F23Q 2/32; F23Q 2/50

See application file for complete search history.

(56) References Cited

U.S. PATENT DOCUMENTS

| | | | | | |
|---|---|---|---|---|---|
| 1,800,334 | A * | 4/1931 | Aronson | F23Q 2/50 | 431/129 |
| 2,505,047 | A * | 4/1950 | Horning | F23Q 2/50 | 431/144 |
| 2,894,515 | A * | 7/1959 | Wismer, Jr. | A24F 9/04 | 131/243 |
| 3,220,420 | A * | 11/1965 | Genoud | F23Q 2/32 | 131/243 |
| 3,263,690 | A * | 8/1966 | Buckley | A24F 9/02 | 131/243 |
| 4,634,374 | A * | 1/1987 | Herko | F23Q 2/50 | 431/146 |
| 4,846,667 | A * | 7/1989 | Lin | F23Q 2/50 | D27/141 |

FOREIGN PATENT DOCUMENTS

| | | | | |
|---|---|---|---|---|
| GB | 733499 A * | 7/1955 | | F23Q 2/32 |
| KR | 200170609 Y1 * | 2/2000 | | F23Q 2/32 |
| KR | 200366786 Y1 * | 11/2004 | | F23Q 2/32 |

* cited by examiner

*Primary Examiner* — Michael G Hoang
*Assistant Examiner* — Logan P Jones
(74) *Attorney, Agent, or Firm* — Weiss & Moy, PC; Jeffrey D. Moy

(57) ABSTRACT

The utility model discloses a multifunctional ignition device, comprising an ignition body, wherein the ignition body comprises a housing, a functional component and a clamping sleeve in slip fit with the functional component; an accommodating cavity perforating through two end faces of the housing in a length direction and used for the arrangement of the clamping sleeve is provided on one side of the housing in a width direction; the functional component comprises a tool pull rod in slip fit with the clamping sleeve and a windshield sheet disposed at an end portion of the tool pull rod and used for resisting wind; when the ignition device is placed in wind, the windshield sheet is slided towards the top of the housing to resist the wind for a flame; and when the ignition device is used outdoors, the tool pull rod can be also slided out from the bottom of the housing, and an extended portion is used as an auxiliary tool such as a cigarette presser and a screwdriver, thereby improving the practicality of the ignition device.

8 Claims, 4 Drawing Sheets

MULTIFUNCTIONAL IGNITION DEVICE

TECHNICAL FIELD

The utility model relates to the field of ignition devices, in particular to a multifunctional ignition device.

BACKGROUND ART

Common ignition devices such as lighters and igniters are mainly used for smoking, cooking and other fire-making, and mainly comprise an ignition mechanism and a gas storage tank containing a liquefied fuel gas. When the ignition mechanism is working, sparks generated thereby are shot towards the gas storage tank to ignite the gas.

However, traditional lighters or igniters have a single function, only an ignition function. Lighters or igniters added with some other functions are also provided on the market, but only some low-applicability and high-cost auxiliary tools are added on the surface of or inside the igniters, and are usually exposed on a surface of a product, which significantly influences an appearance of an ignition device.

Therefore, it is necessary to provide a new multifunctional ignition device to solve the above-mentioned technical problems.

Summary of the Utility Model

The objective of the utility model is to overcome the shortcomings of the prior art and provide a multifunctional ignition device to solve the technical problems proposed in the above-mentioned background art.

The objective of the utility model is achieved by the following technical solutions:

a multifunctional ignition device, comprising an ignition body, wherein the ignition body comprises a housing, a functional component and a clamping sleeve in slip fit with the functional component; and an accommodating cavity perforating through two end faces of the housing in a length direction and used for the arrangement of the clamping sleeve is provided on one side of the housing in a width direction.

In the above summary of the utility model, further, the functional component comprises a tool pull rod in slip fit with the clamping sleeve and a windshield sheet disposed at an end portion of the tool pull rod and used for resisting wind; the tool pull rod is in slip fit with the clamping sleeve, and the other end of the tool pull rod is a cigarette presser or screwdriver structure; an inner wall of the windshield sheet is fitted with an outer wall of the housing; a slip through port for the slipping of the windshield sheet is further provided on a side wall of the housing; and the slip through port perforates through the top of the housing and is in communication with the accommodating cavity.

In the above summary of the utility model, further, a mounting groove is provided on one side of the windshield sheet away from a side wall of the housing, a heat-insulating sheet is embedded on the mounting groove, and an anti-slip strip is arranged on one side of the heat-insulating sheet away from the windshield sheet.

In the above summary of the utility model, further, a limiting projection is provided on a bottom outer side of the clamping sleeve, and the limiting projection is arranged in a direction away from the slip through port; a limiting groove in clamping connection with the limiting projection is provided at the bottom of an inner side wall of the accommodating cavity; and a limiting face for abutting against the top end face of the clamping sleeve is provided at a near top end of the accommodating cavity.

In the above summary of the utility model, further, a cross section of the clamping sleeve is a U-shaped structure, an opening of the U-shaped structure faces the slip through port, and two ends of the U-shaped structure perforate through two ends of the clamping sleeve to form an accommodating groove; and an inner wall of the accommodating groove is fitted with an outer wall of the tool pull rod, and a limiting block for preventing the tool pull rod from being detached from the bottom of the accommodating groove is provided at the bottom of the accommodating groove.

In the above summary of the utility model, further, a plurality of clamping projections are arranged at intervals on a side wall of the accommodating groove in a height direction of a housing; an outer side wall of the tool pull rod is symmetrically provided with slip faces relative to an axis; and a plurality of clamping grooves capable of being fitted with the plurality of clamping projections are arranged at intervals on the slip face of the tool pull rod in a length direction.

In the above summary of the utility model, further, two limiting blocks are provided and arranged symmetrically along a central axis of the clamping sleeve, and a side wall of the accommodating groove is provided with two clamping projections; and the number of the clamping grooves is greater than the number of the clamping projections, so that the tool pull rod can be slipped step by step in the accommodating groove.

In the above summary of the utility model, further, a bottom sleeve for compressing the clamping sleeve is further provided at the bottom of the housing, and an insertion post is provided on one side of the bottom sleeve facing the housing; an insertion groove for the insertion of the insertion post is provided at the bottom of the housing; a locking screw for threaded connection with the housing is provided at the bottom surface of the bottom sleeve, and the locking screw and the insertion post are arranged coaxially; and a through hole in communication with the bottom of the accommodating cavity and fitted with the locking screw is further provided on the bottom sleeve.

In the above summary of the utility model, further, an slip through hole for the tool pull rod to slip through is provided at the bottom of the clamping sleeve, and an inner diameter of the slip through hole is adapted with an outer diameter of the tool pull rod; and an abutting projection is further provided at the bottom of the clamping sleeve, and when the windshield sheet is slipped to the lowest end, the bottom surface of the abutting projection is abutted against the bottom sleeve.

In the above summary of the utility model, further, a cigarette presser or screwdriver mechanism is provided at an end portion of the other end of an end of the tool pull rod.

The utility model has the following beneficial effects:

the utility model comprises the ignition body, and the ignition body comprises the housing, the tool pull rod and the clamping sleeve; the clamping sleeve is in slip fit with the tool pull rod, the clamping sleeve is fixedly placed in the accommodating cavity of the housing, and the tool pull rod can be slipped up and down along the accommodating groove of the clamping sleeve; in wind, the windshield sheet is slipped above the top of the housing to resist the wind for a flame and prevent the flame from being blown out by the wind; and the end portion of the tool pull rod is slipped out from the bottom of the accommodating cavity, and an extended portion can be used as an auxiliary tool such as a cigarette presser and a screwdriver, thereby improving the practicality of the ignition device.

Brief description of reference signs: 1. housing; 11. accommodating cavity; 111. limiting groove; 112. limiting face; 12. slip through port; 13. insertion groove; 2. functional component; 21. pull rod; 211. clamping groove; 22. windshield sheet; 221. mounting groove; 222. heat-insulating sheet; 2221. anti-slip strip; 3. clamping sleeve; 31. limiting projection; 32. accommodating groove; 321. limiting block; 322. clamping projection; 33. slip through hole; 34. abutting projection; 4. bottom sleeve; 41. insertion post; 42. locking screw.

DETAILED DESCRIPTION OF EMBODIMENTS

The embodiments of the utility model are described below through specific examples, and those skilled in the art can easily understand other advantages and effects of the utility model according to the content disclosed by the specification. The utility model can also be implemented or applied through other different specific embodiments. Various details in the specification can also be modified or changed in various ways based on different perspectives and applications, without departing from the spirit of the utility model. It should be explained that in the case of no conflict, the following embodiments and the features in the embodiments can be combined with each other.

It should be explained that the drawings provided in the following embodiments are only intended to describe the basic concept of the utility model in a schematic manner, and the drawings only show the components related to the utility model and are not plotted according to the number, shape and size of the components during actual implementation; and the mode, number and proportion of various components during actual implementation thereof can be optionally changed, and the arrangement mode of the components thereof can also be more complicated.

EMBODIMENTS

Figure 1:
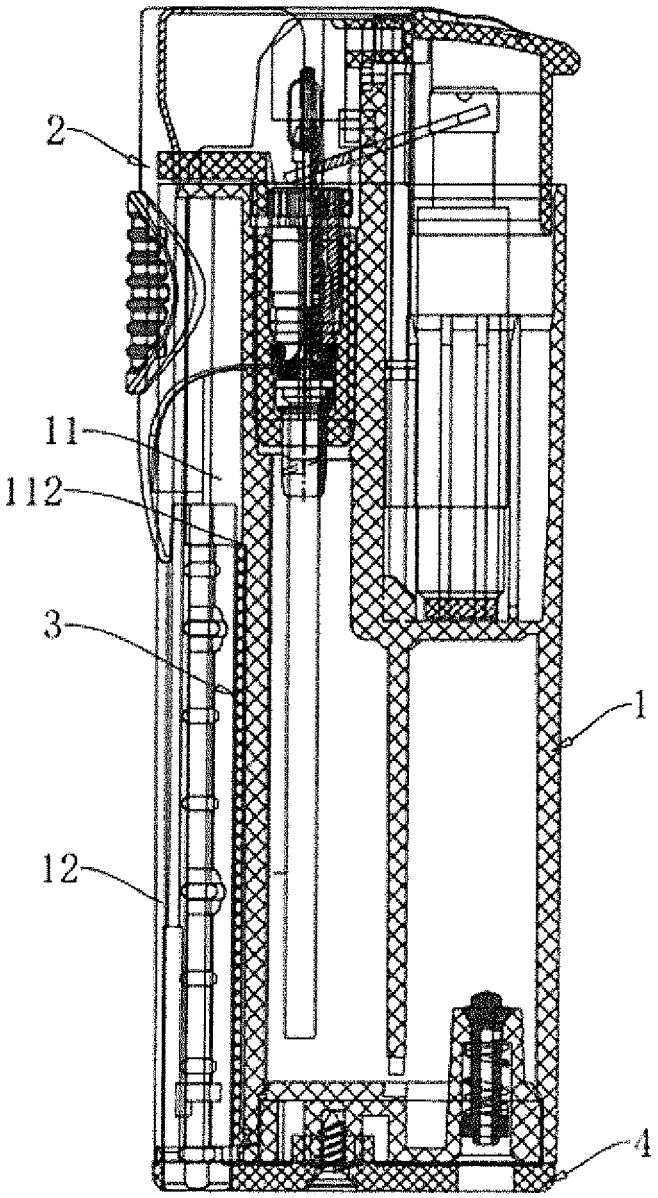
FIG. 1 is an overall cross-sectional schematic diagram of an embodiment of the present application.
Figure 2:
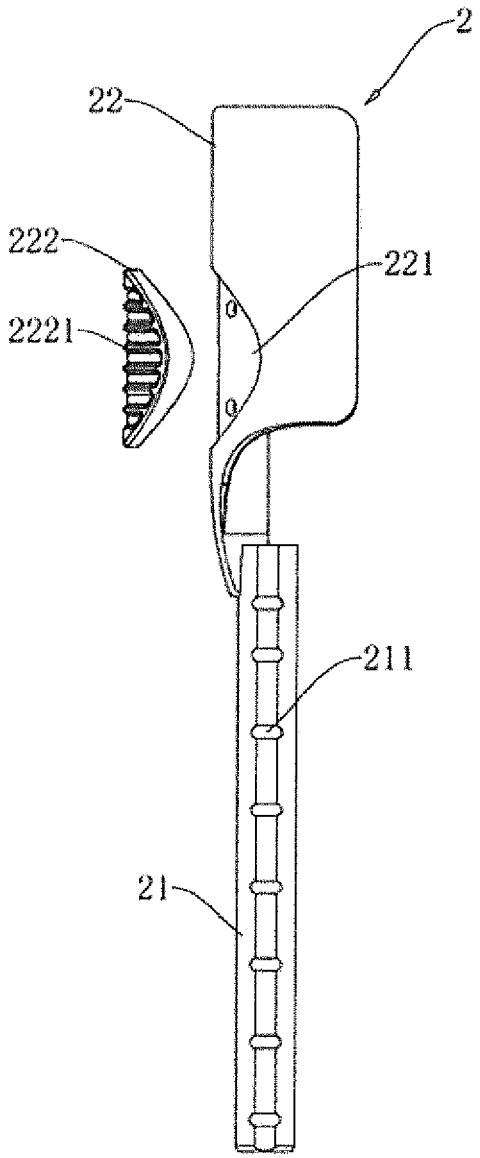
FIG. 2 is a structural schematic diagram of a functional component in an embodiment of the present application.
Figure 3:
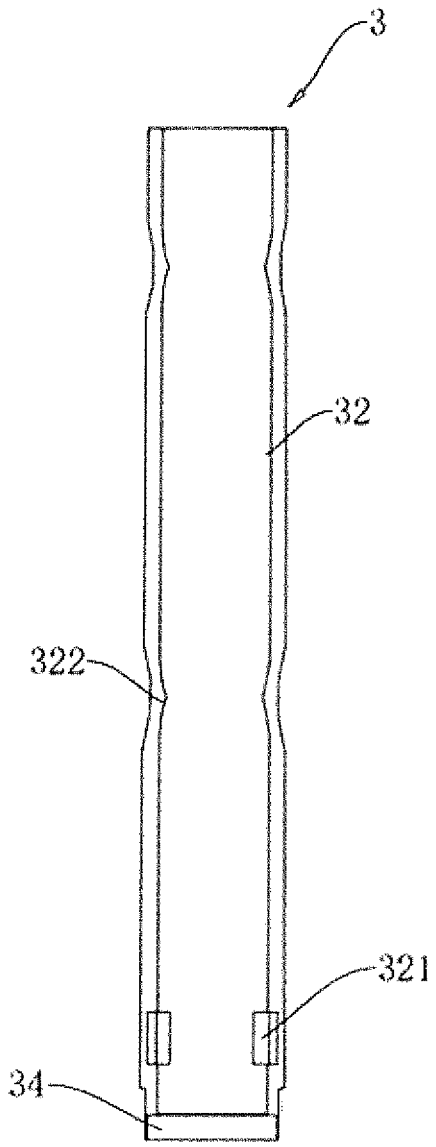
FIG. 3 is a structural schematic diagram of a clamping sleeve in an embodiment of the present application.

Please refer to FIG. 1 to FIG. 3. A multifunctional ignition device comprises an ignition body, wherein the ignition body comprises a housing 1, a functional component 2 and a clamping sleeve 3 in slip fit with the functional component 2; and an accommodating cavity 11 perforating through two end faces of the housing 1 in a length direction and used for the arrangement of the clamping sleeve 3 is provided on one side of the housing 1 in a width direction.

Specifically, the functional component 2 comprises a tool pull rod 21 in slip fit with the clamping sleeve 3 and a windshield sheet 22 disposed at an end portion of the tool pull rod 21 and used for resisting wind; the tool pull rod 21 is in slip fit with the clamping sleeve 3, and the other end of the tool pull rod 21 is designed as a cigarette presser or screwdriver structure; in an actual implementation process, the tool pull rod 21 can be further configured as a structure of a tool in other shapes, and the cigarette presser or screwdriver structure is taken as an example in the present application and does not specifically limit the tool pull rod 21; an inner wall of the windshield sheet 22 is fitted with an outer wall of the housing 1; a slip through port 12 for the slipping of the windshield sheet 22 is further provided on a side wall of the housing 1; and the slip through port 12 perforates through the top of the housing 1 and is in communication with the accommodating cavity 11.

Specifically, the tool pull rod 21 is generally columnar, and the bottom end of the windshield sheet 22 is sheet-shaped with a width less than an outer diameter of the tool pull rod 21 and is fixed with the tool pull rod 21 by welding; and the bottom end of the windshield sheet 22 extends to two sides in a direction away from the tool pull rod 21 to form a U-shaped sheet with an opening facing the housing 1, and an opening side of the U-shaped sheet is fitted with the outer side of the housing 1.

In a specific implementation, an overall length of the functional component 2 is designed as the same as a length of the housing 1. Therefore, when the functional component 2 is in a normal state, the tool pull rod 21 is hidden in the accommodating cavity 11, and the top surface of the windshield sheet 22 is flush with the housing 1, and thus the windshield sheet 22 does not affect the normal use of the ignition device; when the tool pull rod 21 is slipped out from the bottom of the housing 1, the bottom of the tool pull rod 21 can be used as a cigarette presser or a screwdriver, which is convenient for a user to carry outdoors, reduces an occupation space and improves the practicability of the ignition device. Secondly, when the tool pull rod 21 is slipped from the top of the housing 1, the windshield sheet 22 can provide a protection function for a flame generated by the ignition device to prevent the flame from being blown out by wind.

In the above embodiment, most preferably, a circular mounting groove 221 is provided on the windshield sheet 22 starting from a side wall away from the housing 1, and a heat-insulating sheet 222 is embedded at the mounting groove 221 to prevent scalding the user. Therein, anti-slip strips 2221 are disposed horizontally on one side of the heat-insulating sheet 222 away from the windshield sheet 22 and are arranged evenly along the height, to facilitate the user to slip out the windshield sheet 22.

Figure 4:
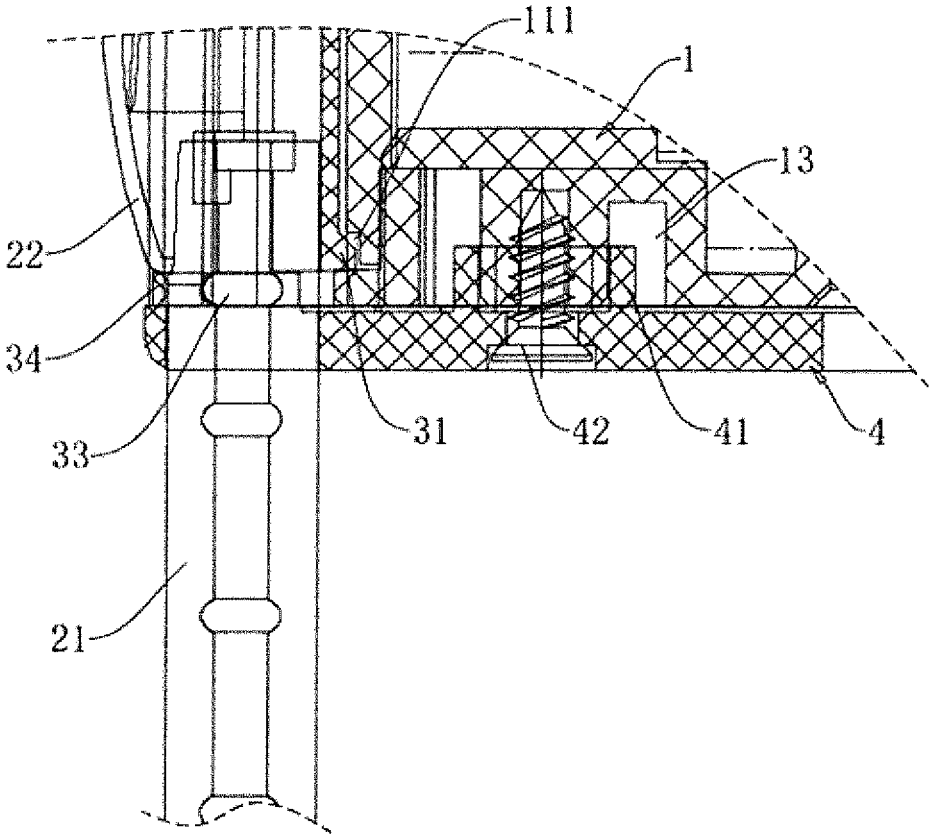
FIG. 4 is a partial structural schematic diagram of a pull rod slipped out from the bottom of a housing according to an embodiment of the present application.

Please continue to refer to FIG. 1, FIG. 3 and FIG. 4. A limiting projection 31 is provided on a bottom outer side of the clamping sleeve 3, and the limiting projection 31 is arranged in a direction away from the slip through port 12; a limiting groove 111 in clamping connection with the limiting projection 31 is provided at the bottom of an inner side wall of the accommodating cavity 11; a length of the clamping sleeve 3 is less than a length of the housing 1; a limiting face 112 for abutting against the top end face of the clamping sleeve 3 is provided at a near top end of the accommodating cavity 11; and under the coordination of the limiting groove 111 and the limiting projection 31, the limiting face 112 is abutted against the top surface of the clamping sleeve 3 to subsequently fix two ends of the clamping sleeve 3.

Specifically, a cross section of the clamping sleeve 3 is a U-shaped structure, and the opening of the U-shaped structure faces the slip through port 12; two ends of the U-shaped structure perforate through two ends of the clamping sleeve 3 to form the accommodating groove 32, and an inner diameter of the accommodating groove 32 is adapted with an outer diameter of the tool pull rod 21, so that the accommodating groove 32 can be fitted with the tool pull rod 21; the clamping sleeve 3 is provided with a limiting block 321 at the bottom of the accommodating groove 32, and the limiting block 321 is used for limiting and preventing the tool pull rod 2 from being detached from the bottom of the accommodating groove 32; two limiting blocks 321 are preferably provided, and the two limiting blocks 321 are symmetrically arranged along a central axis of the clamping sleeve 3; a plurality of clamping projections 322 are arranged at intervals on a side wall of the accommodating groove 32 in a height direction of the housing 1, and an outer side wall of the tool pull rod 21 is symmetrically provided with slip faces relative to an axis; a plurality of clamping grooves 211 fitted with the plurality of clamping projections 322 are arranged at intervals on the slip face of the tool pull rod 21 in a length direction; and under the clamping coordination of the clamping projections 322 and the clamping grooves 211, the tool pull rod 21 is fixed in the clamping sleeve 3. Preferably, a side wall of the accommodating groove 32 is provided with two clamping projections 322, the number of the clamping grooves 211 is greater than the number of clamping projections 322, and preferably, 7-8 clamping grooves 211 are provided. In this solution, the tool pull rod 21 can be slipped step by step in the accommodating cavity 32.

Please continue to refer to FIG. 4. A slip through hole 33 for the tool pull rod 21 to slip through is provided at the bottom of the clamping sleeve 3. Two ends are perforated at the bottom of the accommodating cavity 11, so the tool pull rod 21 can be slipped out from the housing 1. An inner diameter of the slip through hole 33 is adapted with an outer diameter of the tool pull rod 21 to ensure slip stability of the tool pull rod 21, so the tool pull rod 21 does not easily have inclination. An abutting projection 34 is further provided at the bottom of the clamping sleeve 3. The bottom surface of the abutting projection 34 is abutted against the bottom sleeve 4. When the tool pull rod 21 is slipped towards the bottom of the housing 1 to the lowest end, by setting the abutting projection 34, the tool pull rod can be abutted against the bottom end of the windshield sheet 22, thereby limiting the extended length of the tool pull rod 21.

Please continue to refer to FIG. 4. A bottom sleeve 4 for compressing the clamping sleeve 3 is further provided at the bottom of the housing 1, and a cross section of the bottom sleeve 4 is consistent with a cross section of the housing 1. An insertion post 41 is provided on one side of the bottom sleeve 4 facing the housing 1, and an insertion groove 13 for the insertion of the insertion post 41 is provided at the bottom of the housing 1. A locking screw 42 for threaded connection with the housing 1 is provided at the bottom surface of the bottom sleeve 4, and the locking screw 42 and the insertion post are arranged coaxially. Therein, a through hole in communication with the bottom of the accommodating cavity 11 and fitted with the locking screw 42 is provided at the bottom sleeve 4, and the locking screw 42 perforates through the through hole to fix the bottom sleeve 4 at the bottom of the housing 1.

For the above-mentioned embodiments, it should be explained that the ignition principle of the ignition body of the ignition device in the present application is consistent with the ignition principle of piezoceramic igniters in the prior art, so it is not described in the present application; in a specific implementation, first, the tool pull rod 21 of the functional component 2 is inserted into the accommodating groove 32 of the clamping sleeve 3 to connect the functional component 2 and the clamping sleeve 3 under the coordination of the clamping projection 322 and the clamping groove 211; then, the functional component 2 and the clamping sleeve 3 after assembling are placed in the accommodating cavity 11, the clamping sleeve 3 is prefixed in the accommodating cavity 11 under the effects of the limiting groove 111 and the limiting face 112, and the bottom sleeve 4 is subsequently fixed by the locking screw 42. When the ignition device is placed in wind, the windshield sheet 22 is slipped towards the top of the housing 1 to resist the wind for a flame; when the ignition device is used outdoors, the tool pull rod 21 can also be slipped out from the bottom of the housing 1 and the extended portion is used as an auxiliary tool such as a cigarette presser and a screwdriver, thereby improving the practicality of the ignition device.

The above-mentioned embodiments are only intended to describe the specific implementations of the present invention specifically and in details, but should not be construed to limit the scope of the utility model patent. It should be indicated that for those of ordinary skill in the art, several modifications and improvements can be made without departing from the concept of the utility model, which are fall within the protection scope of the utility model.

The invention claimed is:

1. A multifunctional ignition device, comprising an ignition body, wherein the ignition body comprises a housing, a functional component and a clamping sleeve in slip fit with the functional component; and an accommodating cavity perforating two end faces of the housing in a length direction and used for the arrangement of the clamping sleeve is provided on one side of the housing in a width direction;

wherein the functional component comprises a tool pull rod in slip fit with the clamping sleeve and a windshield sheet disposed at an end portion of the tool pull rod and used for resisting wind; the tool pull rod is in slip fit with the clamping sleeve; an inner wall of the windshield sheet is fitted with an outer wall of the housing; a slip through port for the slipping of the windshield sheet is further provided on a side wall of the housing; and the slip through port perforates through the top of the housing and is in communication with the accommodating cavity wherein a mounting groove is provided on one side of the windshield sheet away from a side wall of the housing, a heat-insulating sheet is embedded on the mounting groove, and an anti-slip strip is arranged on one side of the heat-insulating sheet away from the windshield sheet.

2. The multifunctional ignition device according to claim 1, wherein a limiting projection is provided on a bottom outer side of the clamping sleeve, and the limiting projection is arranged in a direction away from the slip through port; a limiting groove in clamping connection with the limiting projection is provided at the bottom of an inner side wall of the accommodating cavity; and a limiting face for abutting against the top end face of the clamping sleeve is provided at a near top end of the accommodating cavity.

3. The multifunctional ignition device according to claim 2, wherein a cross section of the clamping sleeve is a U-shaped structure, an opening of the U-shaped structure faces the slip through port, and two ends of the U-shaped structure perforate through two ends of the clamping sleeve to form an accommodating groove; and an inner wall of the accommodating groove is fitted with an outer wall of the tool pull rod, and a limiting block for preventing the tool pull rod from being detached from the bottom of the accommodating groove is provided at the bottom of the accommodating groove.

4. The multifunctional ignition device according to claim 3, wherein a plurality of clamping projections are arranged at intervals on a side wall of the accommodating groove in a height direction of a housing; an outer side wall of the tool pull rod is symmetrically provided with slip faces relative to an axis; and a plurality of clamping grooves capable of being fitted with the plurality of clamping projections are arranged at intervals on the slip face of the tool pull rod in a length direction.

5. The multifunctional ignition device according to claim 4, wherein two limiting blocks are provided and arranged symmetrically along a central axis of the clamping sleeve, and a side wall of the accommodating groove is provided with two clamping projections; and the number of the clamping grooves is greater than the number of the clamping projections, so that the tool pull rod can be slipped step by step in the accommodating groove.

6. The multifunctional ignition device according to claim 5, wherein a bottom sleeve for compressing the clamping sleeve is provided at the bottom of the housing, and an insertion post is provided on one side of the bottom sleeve facing the housing; an insertion groove for the insertion of the insertion post is provided at the bottom of the housing; a locking screw for threaded connection with the housing is provided at the bottom surface of the bottom sleeve, and the locking screw and the insertion post are arranged coaxially; and a through hole in communication with the bottom of the accommodating cavity and fitted with the locking screw is further provided on the bottom sleeve.

7. The multifunctional ignition device according to claim 6, wherein an slip through hole for the tool pull rod to slip through is provided at the bottom of the clamping sleeve, and an inner diameter of the slip through hole is adapted with an outer diameter of the tool pull rod; and an abutting projection is further provided at the bottom of the clamping sleeve, and when the windshield sheet is slipped to the lowest end, the bottom surface of the abutting projection is abutted against the bottom sleeve.

8. The multifunctional ignition device according to claim 1, wherein a cigarette presser or screwdriver mechanism is provided at an end portion of the other end of an end of the tool pull rod.

* * * * *